US010052649B2

(12) United States Patent
Ding

(10) Patent No.: US 10,052,649 B2
(45) Date of Patent: Aug. 21, 2018

(54) ELECTRONIC FOUNTAIN CANDLE

(71) Applicant: Nantong Ya Tai Candle Arts & Crafts Co., Ltd., Nantong, Jiangsu Province (CN)

(72) Inventor: Yingqi Ding, Nantong (CN)

(73) Assignee: Nantong Ya Tai Candle Arts & Crafts Co., Ltd., Jiangsu (CN)

( * ) Notice: Subject to any disclaimer, the term of this patent is extended or adjusted under 35 U.S.C. 154(b) by 372 days.

(21) Appl. No.: 14/916,558

(22) PCT Filed: Dec. 28, 2015

(86) PCT No.: PCT/CN2015/099198

§ 371 (c)(1),
(2) Date: Mar. 3, 2016

(87) PCT Pub. No.: WO2017/080073

PCT Pub. Date: May 18, 2017

(65) Prior Publication Data

US 2017/0326574 A1 Nov. 16, 2017

(30) Foreign Application Priority Data

Nov. 13, 2015 (CN) ..... 2015 1 0781540

(51) Int. Cl.
*B05B 17/08* (2006.01)
*F21S 9/02* (2006.01)
(Continued)

(52) U.S. Cl.
CPC ..... *B05B 17/08* (2013.01); *F21S 6/00* (2013.01); *F21S 6/001* (2013.01); *F21S 8/00* (2013.01);
(Continued)

(58) Field of Classification Search
CPC ... B05B 17/08; F21S 6/001; F21S 9/02; F21S 10/002; F21W 2121/02; F21W 2131/30
(Continued)

(56) References Cited

U.S. PATENT DOCUMENTS 6,439,471 B2 * 8/2002 Ehrlich ..... F21V 35/00 239/17
2007/0053174 A1 * 3/2007 Lin ..... B05B 17/08 362/96
(Continued)

FOREIGN PATENT DOCUMENTS

CN 201183427 1/2009
CN 102287752 12/2011
(Continued)

OTHER PUBLICATIONS

Office Action for counterpart Chinese Application No. 201510781540.2, dated Nov. 3, 2017; 8 pages.
(Continued)

*Primary Examiner* — Jason Boeckmann
*Assistant Examiner* — Tuongminh Pham
(74) *Attorney, Agent, or Firm* — Loza & Loza, LLP; Michael F. Fedrick

(57) ABSTRACT

The present invention discloses an electronic fountain candle, comprising a candle body, wherein a chamber is formed in the candle body, a stepped water storage tank is arranged in the chamber, and a cover plate is connected to steps of the water storage tank; a first through hole and a plurality of second through holes are formed in the cover plate, a top of the first through hole is higher than an upper surface of the cover plate, a plurality of first light emitting diodes are arranged on two sides of the top of the first through hole, and a bottom of the first through hole is lower than a lower surface of the cover plate and is connected with
(Continued)

a water pump; tops of the second through holes are higher than the upper surface of the cover plate; and a power unit.

10 Claims, 2 Drawing Sheets

(51) Int. Cl.

| | |
|---|---|
| ***F21S 8/00*** | (2006.01) |
| ***F21S 6/00*** | (2006.01) |
| ***F21V 23/04*** | (2006.01) |
| ***F21V 31/00*** | (2006.01) |
| ***F21V 33/00*** | (2006.01) |
| ***F21S 10/00*** | (2006.01) |
| *F21W 121/02* | (2006.01) |
| *F21Y 115/10* | (2016.01) |

(52) U.S. Cl.
CPC ..... *F21S 9/02* (2013.01); *F21S 10/002* (2013.01); *F21V 23/04* (2013.01); *F21V 31/00* (2013.01); *F21V 33/00* (2013.01); *F21W 2121/02* (2013.01); *F21Y 2115/10* (2016.08)

(58) Field of Classification Search
USPC ..... 239/16–23, 289; 392/96, 101, 234
See application file for complete search history.

(56) References Cited

U.S. PATENT DOCUMENTS

2008/0099574 A1* 5/2008 Lin ..... F21S 8/00 239/18
2013/0223043 A1* 8/2013 Ray ..... F21V 33/00 362/96

FOREIGN PATENT DOCUMENTS

| | | |
|---|---|---|
| CN | 104048246 | 9/2014 |
| CN | 204164938 | 2/2015 |
| CN | 204420865 | 6/2015 |
| CN | 204564438 | 8/2015 |
| CN | 204573901 | 8/2015 |
| CN | 205227003 | 5/2016 |
| CN | 205227003 U | 5/2016 |

OTHER PUBLICATIONS

Translation of Office Action for counterpart Chinese Application No. 201510781540.2, dated Nov. 3, 2017; 5 pages.
Office Action and translation for corresponding Chinese Patent Appin. No. 201510781540.2 dated Apr. 1, 2017; 9 pages.
International Search Report, International Patent Application No. PCT/CN2015/099198.
Chinese Application No. 201510781540.2. Office Action & Translation (dated Jan. 25, 2018).

* cited by examiner

ELECTRONIC FOUNTAIN CANDLE

CROSS-REFERENCE TO RELATED APPLICATIONS

This application is the U.S. national stage of International Patent Application No. PCT/CN2015/099198, filed on Dec. 28, 2015 and entitled "Electronic Fountain Candle," which claims the benefit of priority under 35 U.S.C. § 119 from Chinese Patent Application No. 201510781540.2, filed Nov. 13, 2015. The disclosures of the foregoing applications are incorporated herein by reference in their entirety.

TECHNICAL FIELD

The present disclosure generally relates to the field of electronic candles and particularly relates to an electronic fountain candle.

BACKGROUND

Candles are a decorative daily necessity. Traditional candles are mainly used for illumination and realized by wax oil combustion, however, the candles are gradually shortened and even used up by combustion. Meanwhile, with the development of societies, the function of candles is no longer limited to illumination, and the candles also play a role in decorating and enhancing the atmosphere, e.g., a few candles are ignited at a birthday party, a friend's dinner party or a lover's dating, and the flickering candlelight can add the romantic atmosphere. However, the candles of a combustion type are not only troublesome in operation, but also have great potential safety hazards. Electronic candles appear with respect to such a phenomenon, but common electronic candles can only emit lights and can play music at most. Therefore, the electronic candles are low in ornamental value and cannot meet people's current needs.

SUMMARY

In view of the above defects in the prior art, it is required to provide an electronic fountain candle.

The present invention provides an electronic fountain candle, including a candle body, wherein a chamber is formed in the candle body, a stepped water storage tank is arranged in the chamber, and a cover plate is connected to steps of the water storage tank;

a first through hole and a plurality of second through holes are formed in the cover plate, a top of the first through hole is higher than an upper surface of the cover plate, a plurality of first light emitting diodes are arranged on two sides of the top of the first through hole, and a bottom of the first through hole is lower than a lower surface of the cover plate and is connected with a water pump; tops of the second through holes are higher than the upper surface of the cover plate;

a power unit, a chip unit and a second light emitting diode are arranged at a bottom of the chamber, the second light emitting diode is arranged on the chip unit, and the chip unit is connected with the plurality of first light emitting diodes and the water pump by wires, respectively, and is used for controlling flickering of the first light emitting diodes and the second light emitting diode and for on and off of the water pump; and the power unit is connected with the chip unit, the first light emitting diodes, the second light emitting diode and the water pump, respectively, and is used for supplying electric energy to the chip unit, the first light emitting diodes, the second light emitting diode and the water pump.

According to the electronic fountain candle provided by the present invention, water in the water storage tank is pumped by the water pump and is sprayed out to form fountain; and lights of a plurality of light emitting diodes arranged at two ends of the fountain opening are irradiated onto water columns to produce a water flow light effect; meanwhile, the sprayed water can be recycled by two water inlets so that the water is recycled and waste is avoided; and a light emitting diode is further arranged below the candle body so that the candle as a whole has a light effect and the simulating effect is better.

BRIEF DESCRIPTION OF THE DRAWINGS

By reading the detailed description made to nonrestrictive embodiments with reference to the following accompanying drawings, other features, objectives and advantages of the present invention will be more obvious.

DETAILED DESCRIPTION OF THE EMBODIMENTS

The present invention will be further described in detail below in combination with the accompanying drawings and the embodiments. It is to be understood that, the specific embodiments described herein are merely used for explaining the relevant invention, rather than for limiting the present invention. In addition, it should be noted that, for the purpose of convenient description, only the part related with the present invention is illustrated in the accompanying drawings.

It should be noted that, the embodiments in the present application and the features in the embodiments can be combined with one another without conflicts. The present invention will be described in detail below with reference to the accompanying drawings and the embodiments.

Figure 1:
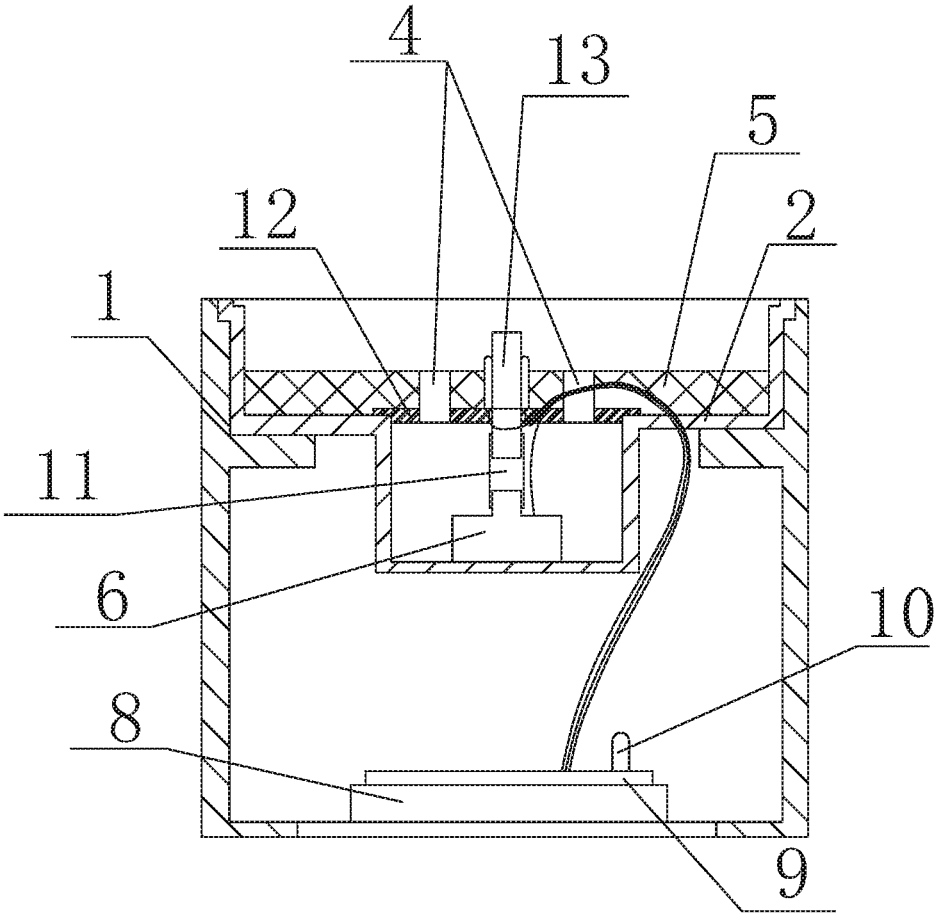
FIG. 1 is a structural schematic diagram of an electronic fountain candle according to the present invention.
Figure 2:
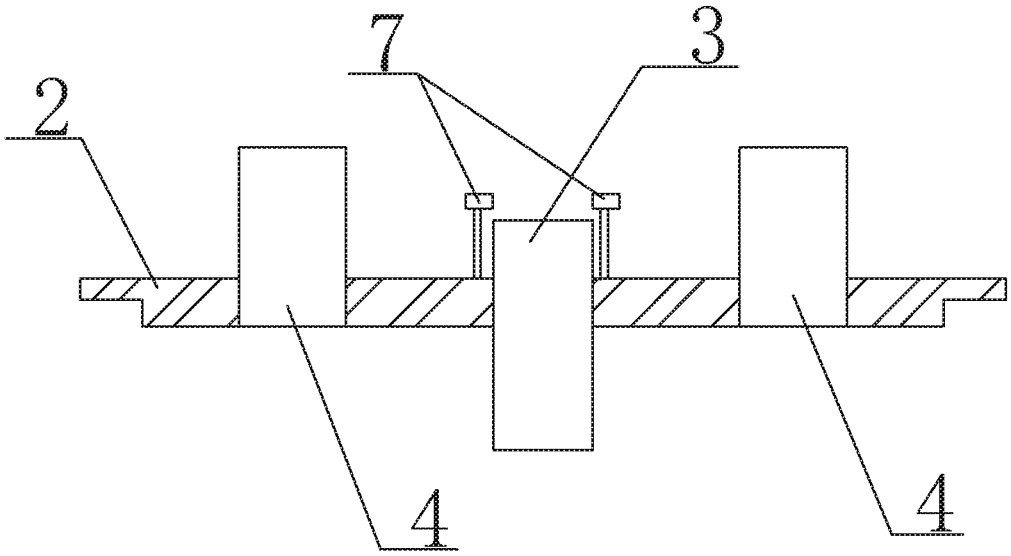
FIG. 2 is a structural schematic diagram of an electronic cover plate according to the present invention.
Figure 3:
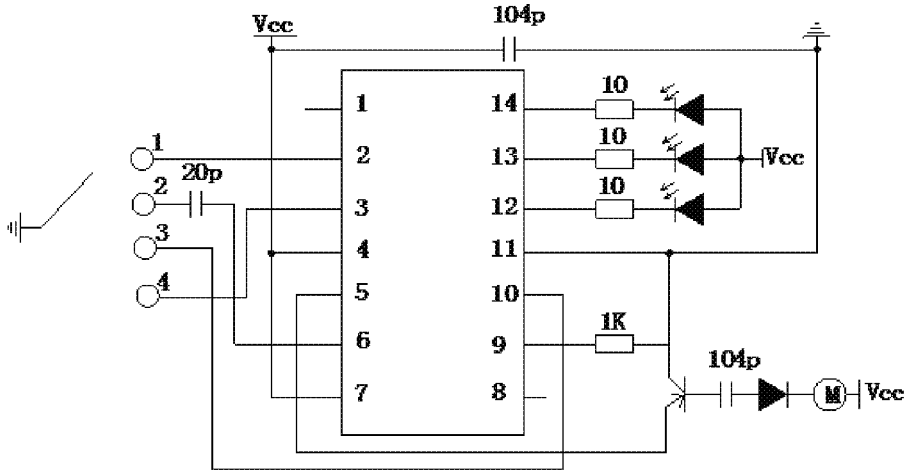
FIG. 3 is a circuit diagram of an electronic fountain candle according to the present invention.

With reference to FIG. 1 and FIG. 2, the present invention provides an electronic fountain candle, including a candle body 1, wherein a chamber is formed in the candle body 1, a stepped water storage tank 2 is arranged in the chamber, and a cover plate 12 is connected to steps of the water storage tank;

a first through hole 3 and a plurality of second through holes 4 are formed in the cover plate 12, a top of the first through hole 3 is higher than an upper surface of the cover plate 12, a plurality of first light emitting diodes 7 are arranged on two sides of the top of the first through hole 3, and a bottom of the first through hole 3 is lower than a lower surface of the cover plate 12 and is connected with a water pump 6; tops of the second through holes 4 are higher than the upper surface of the cover plate 12;

a power unit 8, a chip unit 9 and a second light emitting diode 10 are arranged at a bottom of the chamber, the second light emitting diode 10 is arranged on the chip unit 9, and the chip unit 9 is connected with the plurality of first light emitting diodes 7 and the water pump 6 by wires, respectively, and is used for controlling flickering of the first light emitting diodes 7 and the second light emitting diode 10 and for on and off of the water pump; and the power unit 8 is connected with the chip unit 9, the first light emitting diodes 7, the second light emitting diode 10 and the water pump 6, respectively, and is used for supplying electric energy to the chip unit 9, the first light emitting diodes 7, the second light emitting diode 10 and the water pump 6.

According to the present invention, the cover plate is formed with a plurality of through holes, wherein two of the through holes are used for feeding water, and one of the through holes is used for discharging water, thus achieving a fountain effect. A plurality of bulbs are further arranged at two ends of the fountain opening, and lights are irradiated onto water columns to produce a water flow light effect. The sprayed water flows into the water storage tank from the water inlets so that the water is recycled and waste is avoided. In addition, a light emitting diode is further arranged inside the chamber, and lights penetrate through the chamber and are irradiated through the candle body to form an effect that the overall candle body emits lights. As a result, the simulating effect is better. The colors of the upper and lower light emitting diodes can be set to be different from each other so that a better effect is achieved.

Preferably, the water pump 6 is connected with the bottom of the first through hole 3 by a hose 11. The water pump 6 is arranged inside the water storage tank 2 and is connected with the first through hole 3 by the hose 11, namely, the water pump 6 is connected with a water outlet. The water pump 6 is turned on or off under the control of the chip unit to play a role in spraying water so that the electronic candle has a fountain effect besides illumination.

Preferably, an isolation shield 13 with a water outlet covers the top of the first through hole 3 and the plurality of first light emitting diodes 7.

Preferably, the isolation shield is a cylinder in the middle of which a through hole is formed, blind holes are formed on two sides of the cylinder, and heights of the blind holes are no less than heights of the first light emitting diodes.

A plurality of light emitting diodes are arranged on the two sides of the first through hole, and the adopted light emitting diodes are colored light emitting diodes and have color changes for the purpose of a colorful effect. Meanwhile, because the candle has the fountain effect and can easily cause a short circuit and the like when being arranged beside a water spray port, the isolation shield is arranged above an upper boss hole and the light emitting diodes, and the non-blind holes on the two sides of the isolation shield enclose the plurality of first light emitting diodes. Moreover, the isolation shield is further provided with the water outlet, thus ensuring that water is sprayed out to form a fountain. As shown in FIG. 1, the height of the isolation shield, i.e., the height of the water outlet, is higher than the heights of the water inlets so that the effect of the formed fountain is better and the reutilization rate of water is relatively high.

Preferably, a hole through which the wires pass is formed on the steps of the water storage tank 2.

Preferably, the cover plate 12 is in sealing connection with the water storage tank by glue.

The water pump and the light emitting diodes on the two sides of the water spray port are connected with the power unit and the chip unit at the bottom of the chamber. Therefore, the hole through which the wires pass needs to be formed on the steps of the water storage tank, and the circumference of the cover plate is sealed by glue, thus ensuring that water only flows in from the water inlets and flows out from the water outlet.

Preferably, a sealant layer 5 covers the steps of the water storage tank 2, and an upper surface of the sealant layer 5 is even with the tops of the second through holes.

The sealant covers the water storage tank so that, on one hand, such parts as the cover plate, the wires and the like can be fixed, and on the other hand, the heights of the step surface of the water storage tank can be increased to be equal to the heights of the tops of the second through holes, namely, the water inlets, thus facilitating water feeding.

Preferably, the water storage tank 2 is one with an integrated structure.

The water storage tank of the fountain candle provided by the present invention is one with an integrated structure so that water stored therein does not leak to influence the use of the electronic candle.

Preferably, a switch is further connected between the chip unit and the power unit, the switch is used for controlling the connection between the chip unit and the power unit, and the switch is a single-pole four-throw switch.

The candle according to the present invention includes a plurality of light emitting elements and a water pump. The chip unit controls the turn-on of each element. The switch unit controls the connection between the chip unit and the power unit. The switch is a single-pole four-throw switch and has four gears. When the switch is toggled to a first gear, the water pump is started to form a fountain effect; when the switch is toggled to a second gear, all the light emitting diodes are lightened to form a candle effect; when the switch is toggled to a third gear, the candle is turned off; and when the switch is toggled to a fourth gear, the water pump is turned on, and all the light emitting diodes are lightened, thus forming an effect of fountain and candle.

The power unit is a direct-current power supply. Output voltages of the direct-current power supply of the power unit are 1.5V, 3V, 4.5V or 6V, and generally, the electric energy can be supplied by one or more series of dry cell batteries of 1.5V or other batteries such as button cell batteries and the like.

Preferably, the chip unit includes an MCU (Micro Control Unit) chip and a peripheral circuit unit; the MCU chip is connected with the peripheral circuit unit through an interface, and the peripheral circuit unit is connected with a light emitting unit, the plurality of light emitting diodes and the water pump; and the MCU chip controls flickering of the light emitting unit and the light emitting diodes and turn-on of the water pump by controlling the peripheral circuit unit.

The specific circuit diagram is shown in FIG. 2. The fountain candle according to the present invention includes an MCU chip, and the MCU chip includes 14 interfaces and is connected with the electronic elements in the peripheral circuit through the interfaces. The peripheral circuit is connected with the light emitting elements and the water pump, thus controlling the flickering of the light emitting elements and the light emitting diodes and turn-on of the water pump.

A plurality of light emitting diodes are adopted as the light emitting elements, and the light emitting diodes are monofilament ones and/or color change ones. As shown in FIG. 2, anodes of the three light emitting diodes are connected with the power supply, and cathodes of the three light emitting diodes are respectively connected to pins 12, 13 and 14 of the MCU chip by a 10Ω resistor. One end of the water pump is connected with the power supply, and the other end of the water pump is connected to a base of a triode by a diode and a 104 pF capacitor. A collector and an emitter of the triode are respectively grounded and are connected to a pin 5; the pin 11 of the MCU chip is grounded, and the 104 pF capacitor is connected between the pin 11 and a pin 4. Moreover, pins 2, 6, 10 and 3 are respectively connected to the gears 1 to 4 of the switch, wherein a 20 pF capacitor is connected between the pin 6 and the gear 2, and the pins 4 and 7 are respectively connected to the power supply.

Optionally, a disc is further arranged on the isolation shield, a third through hole matched with the isolation shield is formed in a center of a lower surface of the disc, a plurality of inclined holes are uniformly formed in an upper surface of the disc, and pipelines are arranged below the plurality of inclined holes in a connected manner and are connected to the third through hole. According to the invention, the disc is arranged on the isolation shield and is provided with a plurality of inclined holes. The inclined holes are in the same inclination direction and have inclination angles of 20-50 degrees, and therefore when water in the fountain candle is sprayed out from the through hole of the isolation shield and then sprayed out from the inclined holes via the third through hole and the pipelines, the sprayed water flow has a certain angle and may provide a force for a turntable on the disc to drive the turntable to rotate.

Optionally, a turntable is arranged in the center of the disc, a fourth through hole connected with the disc is formed in the center of the turntable, a plurality of division plates are uniformly arranged between the fourth through hole and the turntable, and the division plates are placed vertically or obliquely. According to the fountain candle in the present invention, water flow with a certain angle is sprayed out through the plurality of inclined holes and then sprayed onto the division plates on the turntable to provide a plurality of forces for the plurality of division plates respectively. Therefore, the division plates can move in the same direction and then drive the turntable to rotate, where the division plates can be placed vertically or obliquely according to a rotation requirement of an actual turntable.

Optionally, an ornament is arranged above the fourth through hole, a boss is formed at a bottom of the ornament, the boss is formed by matching with the fourth through hole, and the turntable drives the ornament to rotate. In order to increase the interestingness of the fountain candle and the user experience, different ornaments may be placed on the turntable. Bosses matched with the fourth through holes are formed at the bottoms of the ornaments, the rotating turntable drives the ornaments to rotate, and light flickers at the fountain opening. As a result, a more interesting fountain candle can be formed. Meanwhile, different ornaments, such as an angel model or a Christmas tree model, can replace one another according to the needs of users.

According to the fountain candle in the present invention, the integrated water storage tank ensures that the candle works stably and water leakage and the like is avoided. Meanwhile, a plurality of light emitting diodes are arranged at a top of and at a bottom of the electronic candle, where the light of the upper light emitting diodes is irradiated onto water columns to generate a water flow light effect, and the lower light emitting diode enables the entire candle to have a light effect. Therefore, a fountain and an electronic candle are integrated to meet diverse requirements of the users.

Described above are merely preferred embodiments of the present application and illustration of the adopted technical principles. It is to be understood by those skilled in the art that, the invention scope involved in the present application is not only limited to the technical solutions formed by specific combinations of the abovementioned technical features, but also covers other technical solutions formed by any combination of the abovementioned technical features or equivalent features thereof without departing from the inventive concept, such as technical solutions formed by mutual substitutions of the abovementioned features and the technical features disclosed (but not limited to) in the present application and having similar functions.

What is claimed is:

1. An electronic fountain candle, comprising:

a candle body, wherein a chamber is formed in the candle body, a stepped water storage tank is arranged in the chamber, and a cover plate is connected to steps of the water storage tank;

wherein a first through hole and a plurality of second through holes are formed in the cover plate, a top of the first through hole is higher than an upper surface of the cover plate, a plurality of first light emitting diodes are arranged on two sides of the top of the first through hole, and a bottom of the first through hole is lower than a lower surface of the cover plate and is connected with a water pump, and wherein tops of the second through holes are higher than the upper surface of the cover plate;

a power unit, a chip unit and a second light emitting diode, wherein the power unit, chip unit and second light emitting diode are arranged at a bottom of the chamber, the second light emitting diode is arranged on the chip unit, and the chip unit is connected with the plurality of first light emitting diodes and with the water pump by wires and is used for controlling flickering of the first light emitting diodes and the second light emitting diode and for turning the water pump on and off;

wherein the power unit is connected with the chip unit, the first light emitting diodes, the second light emitting diode, and the water pump, and is used for supplying electric energy to the chip unit, the first light emitting diodes, the second light emitting diode and the water pump.

2. The electronic fountain candle of claim 1, wherein the water pump is connected with the bottom of the first through hole by a hose.

3. The electronic fountain candle of claim 1, wherein an isolation shield with a water outlet covers the top of the first through hole and the plurality of first light emitting diodes, the isolation shield is a cylinder in the middle of which a through hole is formed, blind holes are formed on two sides of the cylinder, and heights of the blind holes are no less than heights of the first light emitting diodes.

4. The electronic fountain candle of claim 1, wherein the cover plate is in sealing connection with the water storage tank by glue.

5. The electronic fountain candle of any of claims 1-4, wherein a sealant layer covers the steps of the water storage tank, and an upper surface of the sealant layer is even with the tops of the second through holes.

6. The electronic fountain candle of claim 3, wherein a disc is further arranged on the isolation shield, a third through hole matched with the isolation shield is formed in a center of a lower surface of the disc, a plurality of inclined holes are uniformly formed in an upper surface of the disc, and pipelines are arranged below the plurality of inclined holes in a connected manner and are connected to the third through hole.

7. The electronic fountain candle of claim 6, wherein a turntable is arranged in the center of the disc, a fourth through hole connected with the disc is formed in the center of the turntable, a plurality of division plates are uniformly arranged between the fourth through hole and the turntable, and the division plates are placed vertically or obliquely.

8. The electronic fountain candle of claim 7, wherein an ornament is arranged above the fourth through hole, a boss is formed at a bottom of the ornament, the boss is formed by matching with the fourth through hole, and the turntable drives the ornament to rotate.

9. The electronic fountain candle of claim 1, wherein the water storage tank has an integrated structure.

10. The electronic fountain candle of claim 1, wherein the chip unit comprises a MCU chip and a peripheral circuit unit; the MCU chip is connected with the peripheral circuit unit through an interface, and the peripheral circuit unit is connected with a light emitting unit, the plurality of light emitting diodes and the water pump; and the MCU chip controls flickering of the light emitting unit and the light emitting diodes and turn-on of the water pump by controlling the peripheral circuit unit.

* * * * *